US006254490B1

(12) United States Patent
Lawson et al.

(10) Patent No.: US 6,254,490 B1
(45) Date of Patent: Jul. 3, 2001

(54) AUTOMATED SWINGING DEVICE

(76) Inventors: Sydney William Lawson; Ronald David Lawson, both of 539 Kinney Mill Rd., Mt. Airy, GA (US) 30563

( * ) Notice: Subject to any disclaimer, the term of this patent is extended or adjusted under 35 U.S.C. 154(b) by 0 days.

(21) Appl. No.: 09/540,392

(22) Filed: Mar. 31, 2000

(51) Int. Cl.[7] ..... A63G 9/16
(52) U.S. Cl. ..... 472/119; 472/125; 297/273
(58) Field of Search ..... 472/118, 119, 472/125; 297/273, 274, 275, 276, 277, 281; 5/108, 109; 310/78, 92

(56) References Cited

U.S. PATENT DOCUMENTS

| | | | | |
|---|---|---|---|---|
| 3,842,450 | | 10/1974 | Pad | 5/109 |
| 4,491,317 | * | 1/1985 | Bansal | 472/119 |
| 4,911,429 | | 3/1990 | Ogbu | 272/86 |
| 5,574,339 | | 11/1996 | Kattwinkel et al. | 318/10 |
| 5,833,545 | * | 11/1998 | Pinch et al. | 472/119 |
| 5,846,136 | | 12/1998 | Wu | 472/119 |

* cited by examiner

*Primary Examiner*—Kien T. Nguyen
(74) *Attorney, Agent, or Firm*—Carnes Cona Dixon

(57) ABSTRACT

An automatic swing device to be used in combination with a conventional porch swing is disclosed and includes a frame member that will support a conventional porch swing and maintain the components of the automatic swing device. Secured to the swing is a motorized rotating arm assembly. This rotating arm assembly includes a fractional horsepower gear motor. An initiation assembly is coupled to the rotating arm assembly. This initiation assembly includes a clutch arm that is connected to a stop unit. The stop unit is connected to the fractional horsepower gear motor. In operation, the user sits on the swing and pushes back, this will cause the rotating arm assembly to active the initiation assembly. The initiation assembly will provide for the clutch arm to pull back, forcing the stop unit to be disengage and cause for the automatic operation of the device.

19 Claims, 6 Drawing Sheets

AUTOMATED SWINGING DEVICE

BACKGROUND OF THE INVENTION

1. Field of the Invention

The present invention relates to a unique and useful automatic swinging device and more particularly to a swinging device that will maintain the natural rhythm of the swinging motion without the feel of any forced motion or any effort from the passenger.

2. Description of the Prior Art

The relaxation afforded by sitting and swinging on a porch swing is unsurpassed as one of life's great pleasures. U.S. Pat. No. 5,846,136 issued to Wu discloses a swing chair device for young children which has a simplified control/drive mechanism. However, this device has no natural swinging rhythm, no angular or magnitude adjustment, cannot swing independent of the motor control mechanism and has forced unnatural motion forward and backwards. In addition, the swing chair device is uncomfortable due to a maintained fixed motion, as well as noisy due to the drive mechanism being at nearly head-level and close to the user's ear. U.S. Pat. No. 5,574,339 issued to Kattwinkel et al discloses a typical prior art swing device for rocking furniture. Although U.S. Pat. No. 5,574,339 claims natural rhythm and magnitude or angular adjustment, this device has limited magnitude adjustment, features limited movement and features friction losses due to the backwards freewheeling motor during 100% of the return cycle. Furthermore, since the swing is mechanically connected 100% of the time with the motor, wheel and bar, true natural rhythm cannot be achieved since the passengers mass and momentum would have to rotate through the rack and pinion arrangement during conventional swinging (without the motor/controller device). In addition, this device uses microprocessors and sensors which increase the chance for simple electronic failures, both are very susceptible to lightning damage and both require specialized parts for replacement. U.S. Pat. No. 4,911,429 issued to Ogbu is also another prior art device, however it provides no magnitude adjustment and also does not provide for natural rhythm in the swing. The disadvantages of this device include an unsightly and bulky device for any kind of furniture, duplicate motor/drive mechanisms for each side of the device and having to maintain a battery charge. In addition, the device in question will have pronounced wobbling if there are any minuet differences in the motor characteristics such as speed or wattage/horsepower. U.S. Pat. No. 3,842,450 issued to Pad disclose a typical prior art swing device for rocking furniture. Although U.S. Pat. No. 3,842,450 claims natural rhythm and angular adjustment, it is somewhat crude producing a loud impacting and humming noise as a result of the plunger on a solenoid engaging. Also, over-swinging during a light swing setting would result in mechanical restrictions resulting in pronounced discomfort. Additionally, varying weights of the passenger will change the angle of the swing appreciably.

None of these previous efforts, however, provide the benefits intended with the present invention or method. The present invention provides a product that is directly marketable to the consumer. Additionally, prior techniques do not suggest the present inventive combination of component elements as disclosed and claimed herein.

Accordingly, there is a pressing need for a novel and useful automatic swing device, preferable used with porch swings or the like, that is designed and configured for the passenger in order to maintain the natural rhythm of the swinging motion of the particular swing without the feel of any forced motion or any effort. In addition, the composition of the instant invention is simple in design, includes a minimal number of components in order to innately reduce and/or eliminate the possibility of component failure.

Thus, as can be seen, the present invention achieves its intended purposes, objectives and advantages over the prior art device by accomplishing the needs and objectives as identified herein, through a new, useful and unobvious combination of component elements, which is simple to use, with the utilization of a minimum number of functioning parts, at a reasonable cost to manufacture, assemble, test and by employing only readily available materials.

SUMMARY OF THE INVENTION

The present invention provides for an automatic swinging device with a natural rhythm of the swinging motion that, in one embodiment is adapted to be installed in standard household ceiling joints on sixteen-inch centers. This swinging device of the present invention is ideally suited for use with a conventional porch swing, but can be utilized with other seat apparatus that would benefit from an automatic swing device attached thereto. It is further noted that the present invention is described as being attached to an existing ceiling, but the embodiment can be altered so that the automatic swing device is installed in a freestanding main frame. Such an arrangement will provide for a transportable swinging unit.

The swinging device of the present invention includes a base frame having four members that form a substantial rectangular configuration. Enhancing the frame, each member has an L-shape configuration. It is noted that the four members forming the base frame can be fabricated from conventional angle iron and it has been used to produce favorable results. However, other material, having substantially the same shape and structural strength, such as plastic, or reinforced plastic, can be used in placed of the angle iron.

Located at each end of the base frame is a standard pillow block bearing. This pillow block bearing is used to support a main shaft used in the support of a conventional swing, such as a two/three person swing used on a porch, gazebo or the like.

Secured to the top of the frame is a motor base for accepting and maintaining a conventional motor. This motor is secured via conventional means, such as the use of brackets, welding or the like to the motor base. The conventional motor is a 120 VAC fractional horsepower gear motor that is mounted and secured on the motor base.

Coupled to the motor is the swing assembly. This swing assembly enables the conventional swing to automatically rock continuously and with no effort from the user.

Accordingly, one of the primary objects of the present invention is to design and configure a novel, useful and unobvious swing device that can be coupled to a conventional swing apparatus, such as a porch swing or the like, which will swing continuously at an unimpeded natural rhythm requiring no effort by the user.

Yet another object of the present invention is to provide for a swinging device which will overcome the deficiencies, shortcomings, and drawbacks of prior swinging devices and methods thereof.

Still another object of the instant invention is to incorporate into the design a conventional swing with a much smoother and quieter ride, and one that will operate independently of the motor.

Another object is to provide for a means of magnitude adjustments from maximum through minimum swinging angles.

Yet another object of the present invention is to design and configure the device so that it can be installed in standard overhead building construction practices with only a 120 VAC receptacle required. Optionally, the present invention can also be designed as a freestanding unit wherein the frame can be a stand that houses the motor and swing assembly.

A further object of the present invention is to design and configure a device so that it is comprised of only one electrical device to inherently reduce costly repair/service calls.

As seen, other prior art devices use sophisticated electronic control circuits and sensors which are often susceptible to lightning and other problems as well as being difficult to service and costly to repair due to specialty parts replacement. Another object of the instant invention is to provide for a conventional swing device that enables the swing, attached thereto, to operate independently of the motor.

Another object of the present invention is to minimize the duration of the added energy produced by the motor control device, which is necessary to maintain the swinging motion, to only a fraction of the complete cycle. Therefore if anything were to be felt by the passenger, it would only be momentary and the rest of the cycle will be natural motion, free of any mechanical interference.

Still a further object of the present invention, to be specifically enumerated herein, is to provide a swing device in accordance with proceeding objects and which will conform to conventional forms of manufacture, be of simple construction and easy to use so as to provide a device that would be economically feasible, long lasting and relatively trouble free in operation.

Although there have been many inventions related to swing devices, none of the inventions have become sufficiently compact, low cost, reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
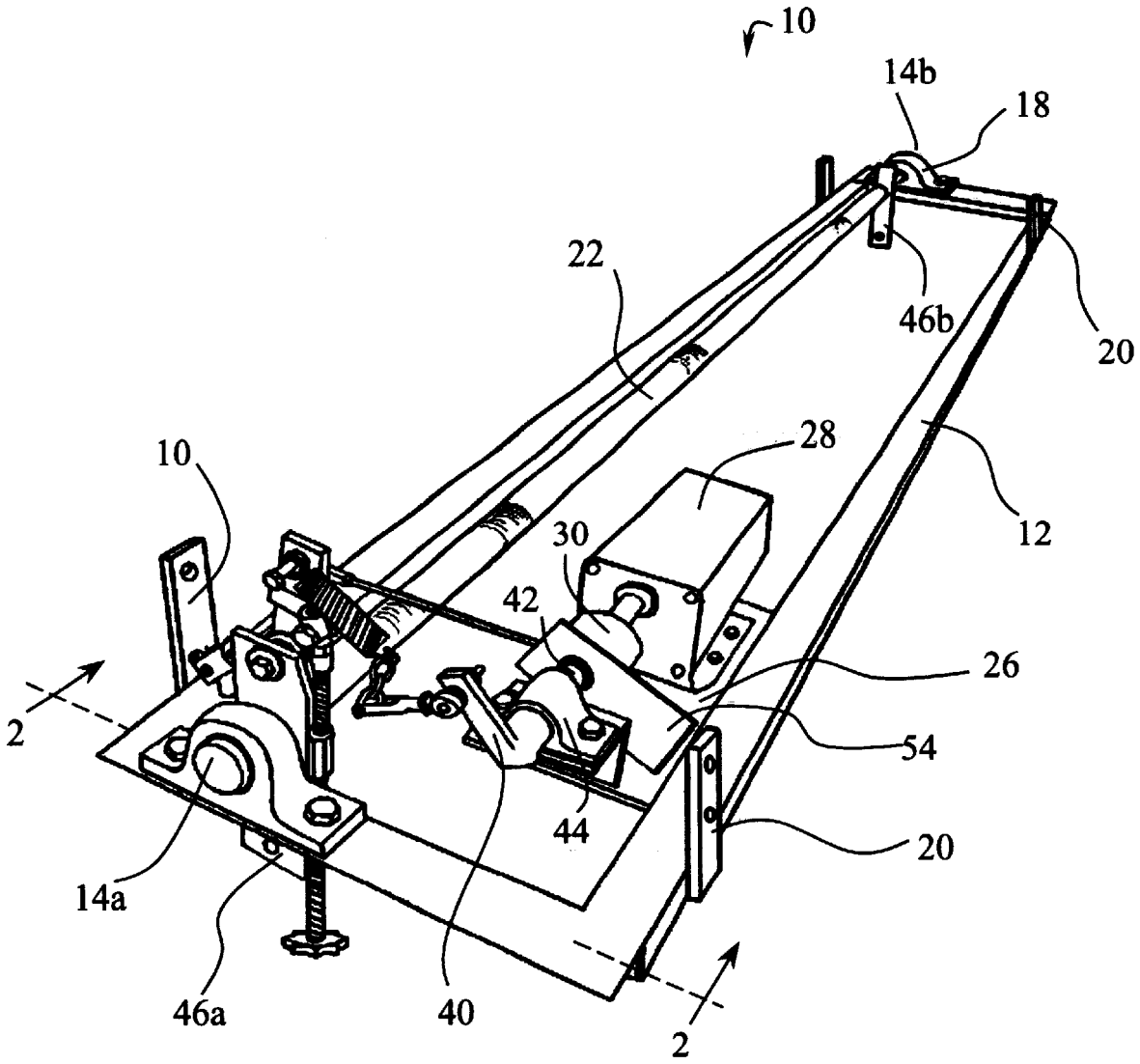
FIG. 1 is a perspective view of the automatic swing device of the present invention.
Figure 2:
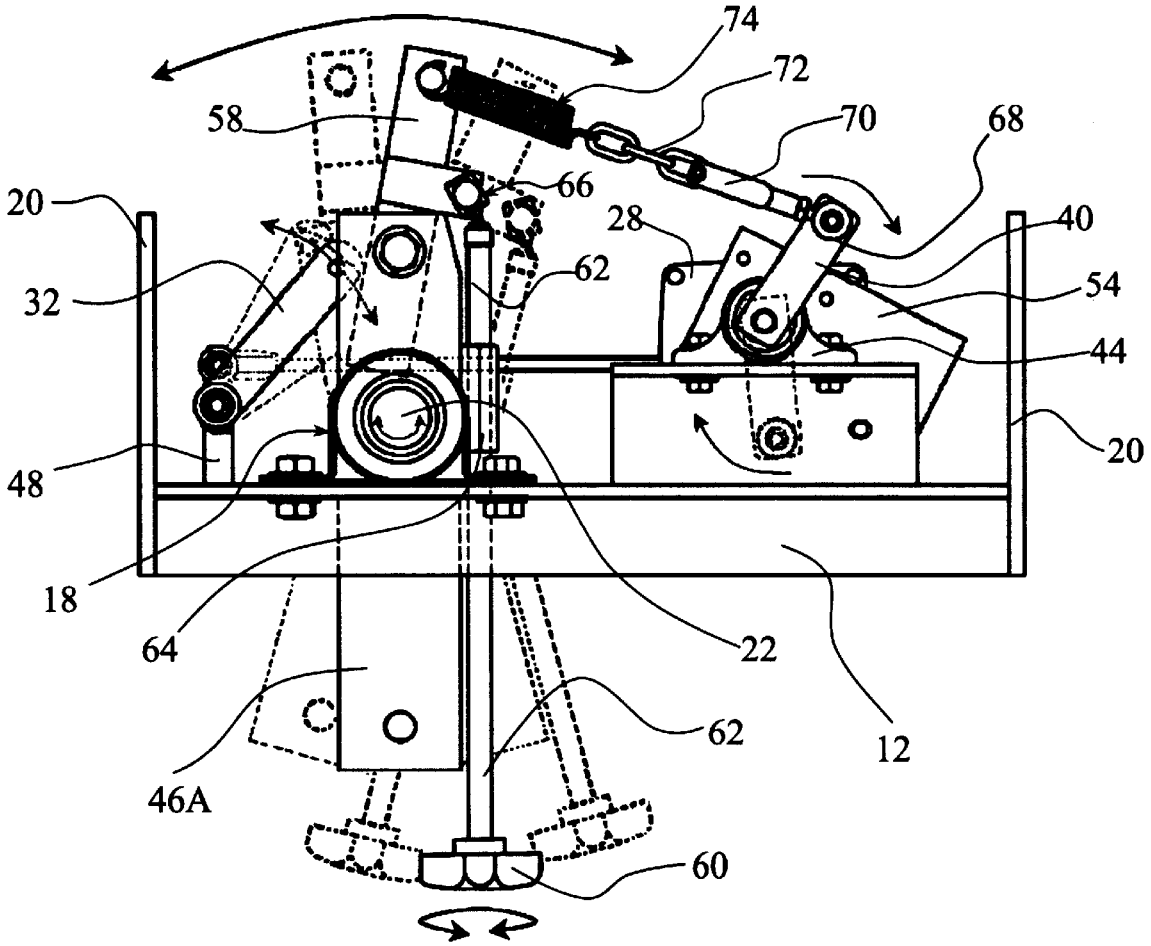
FIG. 2 is a cross-sectional view of the automatic swing device of the present invention taken along lines 2—2 of FIG. 1.

With reference to the drawings and in particular to FIGS. 1–9 wherein an automatic swinging device constructed in accordance with the present invention, generally designated at 10, is shown. As seen in FIG. 1, the automated swing device 10 includes a frame structure 12. Located at opposite ends of the frame structure 12 are pillow block bearings 18. These bearing are conventional and are designed and configured to receive and maintain a main shaft 22.

The main shaft 22 includes opposite distal ends 14*a* and 14*b*, as seen in FIG. 1. Each distal end is received within a pillow block bearing. Secured to the shaft in proximity to the distal ends is a left hand hanging arm 46*a* and a right hand hanging arm 46*b*. A conventional chair, swing or the like (not illustrated) will be secured to the hanging arms 46*a* and 46*b*, respectively, via conventional rigid means, such as the use of a shaft, rod, pole or the like. Preferably, the swing will hang from a chain and will be attached to ends 46*a* and 46*b* via "S" hooks that are inserted into the holes (illustrated, but not labeled) of the hanging arms 46*a* and 46*b*.

The use of pillow block bearings 18 allows for the main shaft to be supported on the frame structure 12 as well as enable the shaft to rotate freely therein, while being secured to the frame. The left and right hand hanging arms also act as a safety measure and prevents the shaft from dislodging from the pillow block bearings 18.

Figure 3:
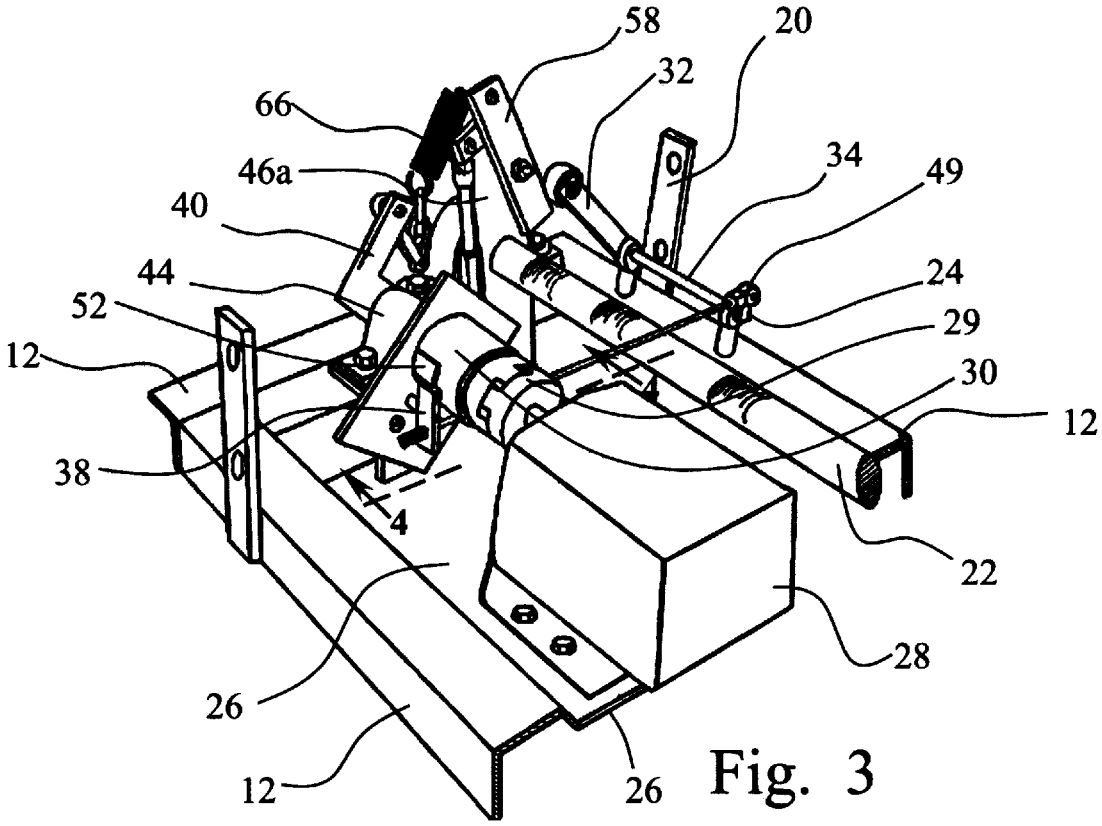
FIG. 3 is an enlarged perspective view of the swing assembly used in the automatic swing device of the present invention.
Figure 6:
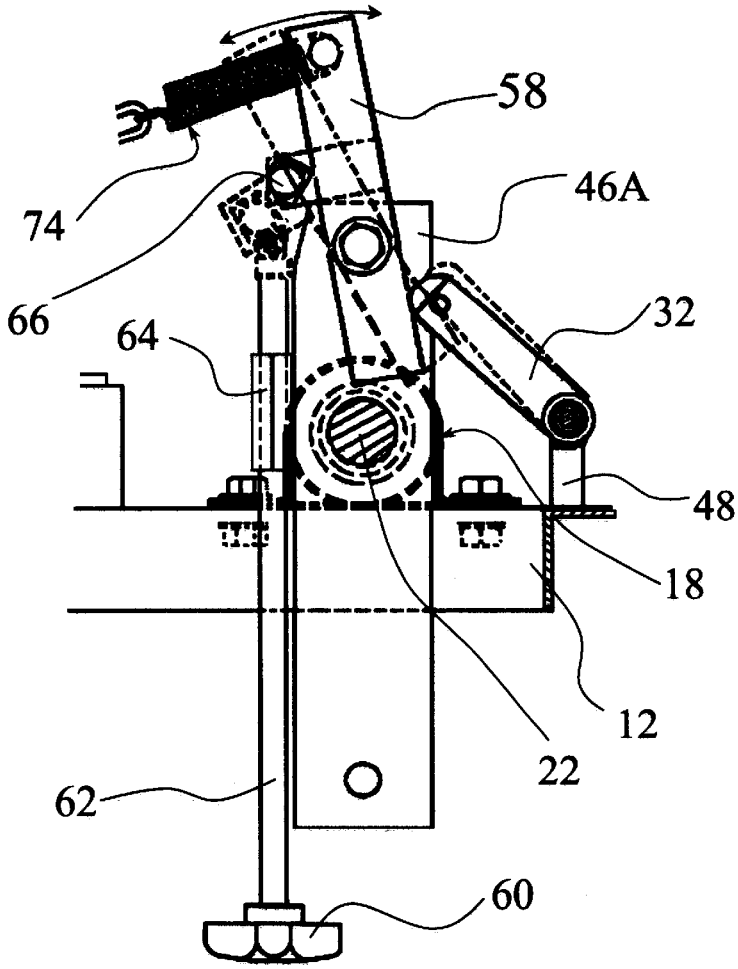
FIG. 6 is cross sectional side view taken along lines 6—6 of FIG. 5 of the adjusting mechanism used in the automatic swing device of the present invention, used for adjusting the swing arch when in the automatic mode.
Figure 5:
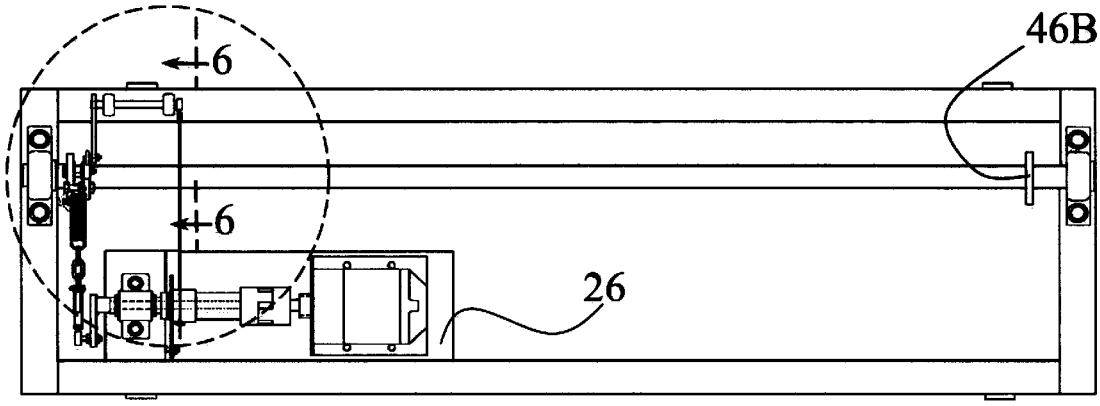
FIG. 5 is a top view of the automatic swing device of the present invention.
Figure 8:
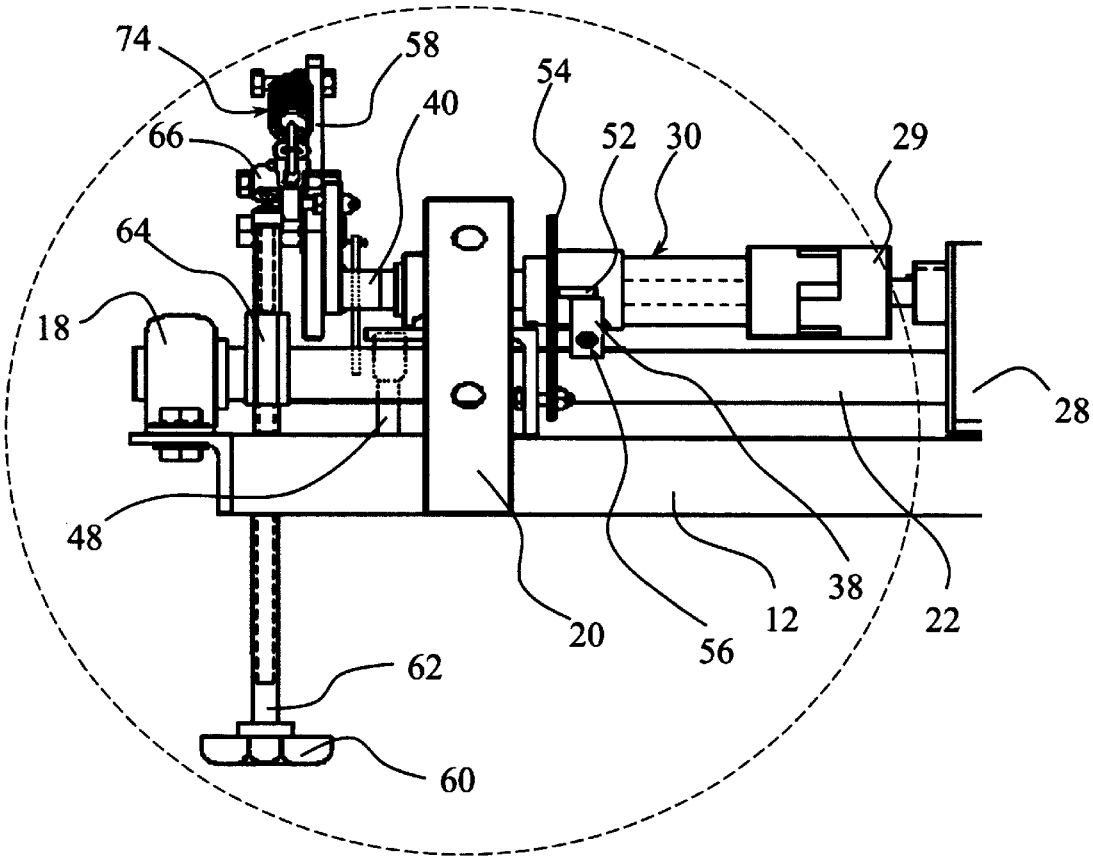
FIG. 8 is an exploded view of the encircled area shown in FIG. 7, of the swing assembly used in the automatic swing device of the present invention.
Figure 7:
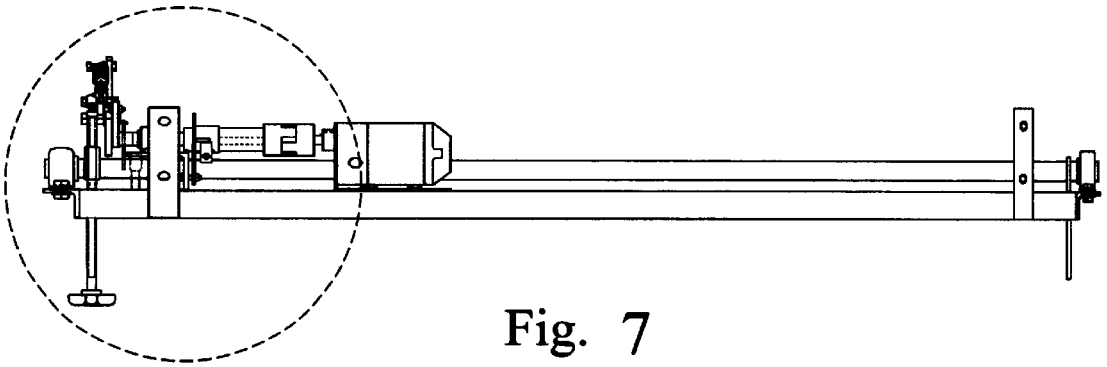
FIG. 7 is a side view of the automatic swing device of the present invention.

As seen in FIGS. 1 and 3, the frame structure 12 is substantially rectangular and comprises of four individual members, illustrated, but not labeled. These four individual members form the rectangular structure. This will provide for a frame structure 12 that includes an opening located centrally therein. Each member, as seen in FIG. 3, can include an L-shape configuration. This L-shape configuration of each member provides for stronger and more structurally sounds unit. The L-shape members that have been utilized to produce favorable results include conventional angle iron. However, it is noted that other material can be utilized.

Extending upwardly from two parallel members of the frame structure are a pair of frame mounts 20. Each frame mount 20 is located in proximity to an end of the frame structure and is used for mounting purposes.

Secured to an individual member of the frame structure and extending into the central open area is a support base 26.

This support base 26 supports and maintains the power unit of the present invention.

The power unit, as seen in FIGS. 1, 3, 8 and 9 comprises a fractional horsepower gear motor 28 that is connected via a coupling 29 to a conventional clutch-brake 30. The clutch-brake 30 is manufactured with a mounting plate 54. Coupled to the clutch-brake 30 is a power distribution shaft 42 that extends through a rigid bearing assembly 44. This shaft 42 is coupled to a rotating arm assembly 40.

In the invention, the motor 28 runs continuously. The clutch-brake 30, when in the non-operational mode (the swing is not being utilized) prevents the rotation of the power distribution shaft 42, and thus prevents the rotating arm assembly 40 from rotating.

During the operation mode, the clutch brake 30 is engaged and this will allow the power distribution shaft 42 to rotate and thus cause the rotating arm assembly 40 to rotate, innately causing activation of the swing unit.

To enable or disable the clutch-brake, an activation assembly is utilized. This activation assembly, or initiation cycle, is illustrated in FIGS. 1, 3, 4, 5, and 9. A roller arm 32, seen in FIGS. 3 and 9, which is coupled to the main shaft via a linkage assembly, is secured to a horizontal shaft 34. Two ball joint rod ends 48 support this shaft 34. Located above and coupled to the two ball joint rod ends 48 is a very short linkage arm 24, which provides leverage, connects the horizontal shaft 34 to the small ball joint rod end connector 49. Connected to the small ball joint rod end connector 49 is a clutch arm connector 36. This clutch arm connector 36 is connected to mounting plate 54 via clutch pedal 38.

Figure 4:
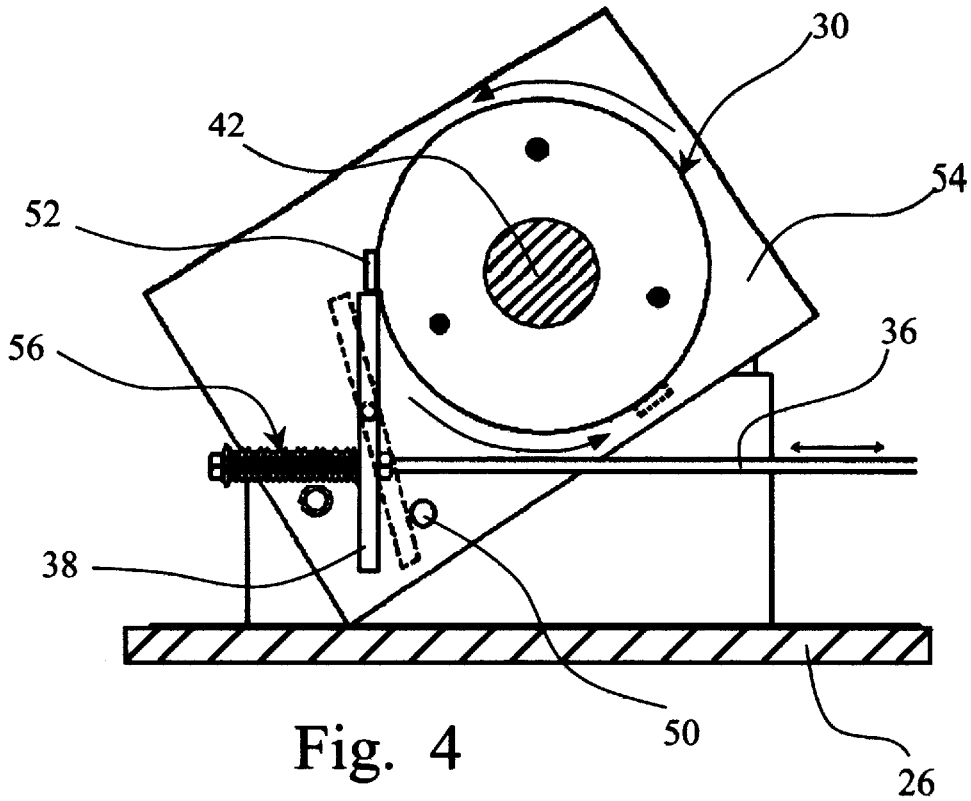
FIG. 4 is a cross-sectional view taken along lines 4—4 of FIG. 3 of the clutch brake used in the swing assembly of the automatic swing device of the present invention.

The clutch petal 38, see FIGS. 3 and 4, in contact with stop point 52 when in a non-operational mode. When in an operational mode, the clutch petal 38 pulled, thus disengaging contact with the stop point 52 and enabling the clutch brake 30 to rotate and initiate.

Initiation of the clutch brake occurs when the roller arm 32 pivots. This causes the horizontal shaft to rotate and innately provides for the ball joint rod ends 48 (see FIG. 9) to rotate. The rotation of the horizontal shaft 34 causes the very short linkage arm 24 to tilt away from the mainframe 12, which causes the small ball joint rod end connector 49 to pull the clutch arm connector 36. Pulling the clutch arm connector 36 causes clutch pedal 38 to tilt (see dash outline in FIG. 4), and provides for the clutch pedal to disengage from the stop point 52. Pulling the clutch arm connector 36 causes clutch pedal 38 to tilt (see dash outline in FIG. 4), and provides for the clutch pedal 38 to disengage from the stop point 52. This causes the clutch brake to rotate, inherently causing the rotating arm assembly 40 (see FIG. 1 and FIG. 3) to rotate 360 degrees clockwise.

Figure 9:
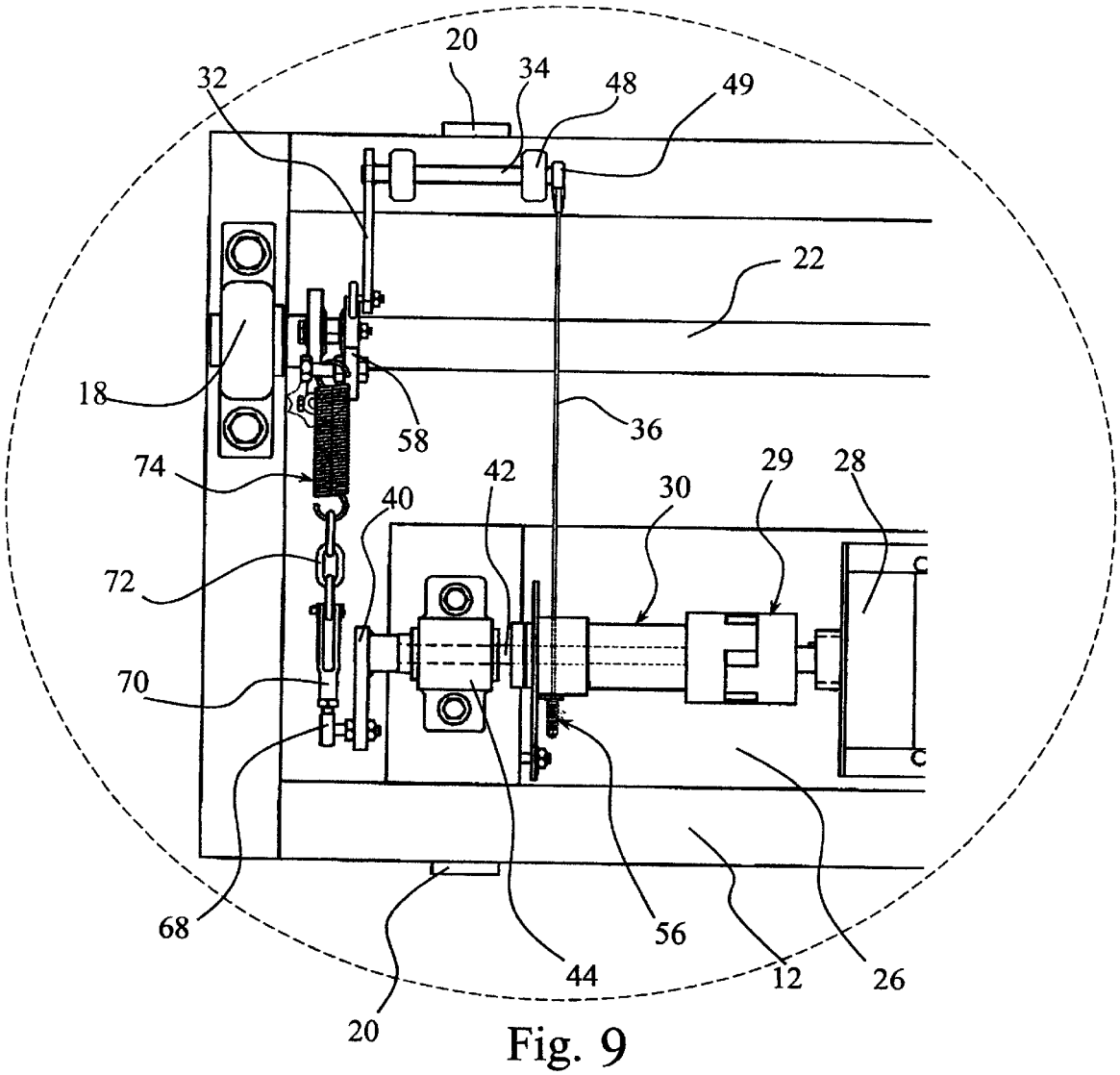
FIG. 9 is an exploded view of the encircled area shown in FIG. 5, of the swing assembly used in the automatic swing device of the present invention.

As illustrated in FIGS. 3, 4, and 9, a compression spring 56 is mounted on the clutch arm connector 36 on the opposite side of the clutch pedal 38. This prevents the swing, in the event of hyperextension in a case where someone pushes the swing farther past the angular setting, from incurring any damage. The clutch arm connector 36 would simply pull and compress the compression spring 56 preventing any mechanical damage to the clutch pedal 38. The compression spring 56 is stout enough to be pulled to release the clutch pedal 38 without compressing under normal operation. The stop 50 also prevents the clutch pedal from extending too far.

When the brake clutch is enabled, the power distribution shaft 42 rotates and causes the rotating arm assembly 40 to rotate 360 degrees clockwise. During rotation the rotating arm assembly 40 pulls one of the two hanging arms 46 approximately fifteen degrees when set at the maximum swing setting from vertical center away from the roller arm 32.

The first hanging arm **46*a* is permanently connected to the main shaft 22 via conventional means, such as by welding or the like. The second hanging arm 46*b* is mounted to the opposite side of the main shaft 22 and moves an equal number of degrees from vertical center depending on the setting, preventing any wobbling effect. The main shaft 22 is keyed on the side where the second hanging arm 46*b* is mounted; allowing width adjustments to accommodate various widths of the swing attached to the main shaft 22**.

The hanging arm 46 will pass vertical center as it swings back in the opposite direction where it will make contact with the roller arm 32. The roller arm 32 is secured to the horizontal shaft 34. As the horizontal shaft 34 rotates it causes the clutch arm connector 36 to pull the clutch petal 38 off the clutch-brake 30, allowing the stop point 52 to circle counter clockwise around the clutch brake 30 (as seen in FIG. 4). Thus, initiating the rotating cycles and returns to the precise same position every time before the start of the next swing cycle by resting on top of the clutch pedal 38. Therefore, the rotating arm assembly 40 is at the exact start position for each swing time and is ready to be engaged at the climax of the swing when the roller arm 32 is pushed backward. The rotating arm assembly 40 arrives back at the start position, thereafter the clutch-brake 30 is disengaged and the brake is applied to the start position before the hanging arm reaches the climax on the return swing. The RPM of the gear motor is selected to be slightly faster than the natural rhythm. This process results in maintaining the correct timing of the swing thereby resulting in a natural swinging rhythm.

The user can control the depth of the swing. Shown in FIGS. 1, 6, 7 and 8 is the device that is used for controlling and adjusting the depth of the swing. To adjust the depth of the swing an adjustable cam 58 is utilized. As seen in the drawings, the adjustable cam 58 is secured to the first hanging arm **46*a*, located in proximity to the swing device. The cam 58 is also coupled to the roller arm 32. The closer the adjustable cam 58 is positioned in relation to the distance from the roller arm 32 the lighter the swing. The greater the distance that the roller arm 32 is from the adjustable cam 58, the greater the swing angle. Thus, the hanging arms 46** will deviate further from the vertical center to a higher degree.

To adjust the cam 58, a control knob 60 is utilized. As seen, the control knob is mounted to the front of the hanging arm 46 with a long threaded rod 62. The long threaded rod bolt is threaded through a coupling nut 64 that is welded to the hanging arm 46. The long threaded rod 62 is connected to the adjustable cam 58 via a ball joint swivel connector 66 that is mounted onto the end of the threaded rod 62. This causes the adjustable cam 58 to move toward and away from the roller arm 32 while also increasing or decreasing the length between the adjustable cam 58 and the male-ball joint rod end 68.

Other features are coupled to the rotating arm assembly for providing a smooth swinging motion. As seen in FIGS. 1, 2, 5, 6 and 8, a male-ball joint rod end 68 is attached to the distal end of the rotating arm assembly 40. A female threaded yoke end assembly 70 is threaded onto the ball joint rod end 68. A chain 72 is fastened to the distal end of the female threaded yoke end assembly 70, which is fastened to a spring 74. The purpose of the chain 72 is to eliminate any rigid mechanical connection between the female threaded yoke end/ball joint rod end connection and the spring 74 allowing the female threaded yoke end assembly 70 and the chain 74 to drop down during conventional swinging (without the use of the motor) thus eliminating mechanical interference. The spring 74 is then connected to the upper end of the adjustable cam 58. The purpose of the spring 74 is to dampen the effect of the pull from the rotating arm assembly 40. The purpose of the male-ball joint rod end 68 is to provide a smooth operation on rotation and prevent any friction or shearing forces from harming the chain 72. When the adjustable cam 58 is set for maximum swing and the swing has reached the full distance in the backward direction, there is very little slack in the link between the male-ball joint rod end 68 and the adjustable cam 58. Therefore, the swing has reached a maximum swinging magnitude and the hanging arm 46 endures a longer duration of the rotating arm assembly's 40 cycle thereby providing a longer duration of force to keep up with the loss of friction over that great a distance. Conversely, if the adjustable cam 58 is set for a minimum swing, the maximum distance between the male-ball joint rod end 68 and the adjustable cam 58 is not reached until the rotating arm assembly 40 is well into the cycle. Thus there is less distance between the adjustable cam 58 and the male-ball joint rod end 68 due to the higher end of the adjustable cam 58 moving closer to the male-ball joint rod end. Therefore the adjustable cam 58 is more quickly connecting to the roller arm 32 thereby decreasing the need to swing further prior to the initiation of the cycle of the rotating arm assembly 40. The magnitude or angle of the swinging is controlled by adjusting the distance between the male-ball joint rod end 68 and the upper end of the adjustable cam 58 as well as the distance between the roller arm 32 and the lower end of the adjustable cam 58.

The motor can be power via conventional means, such as the use of batteries and/or to provide for the unit to be coupled to the existing power source of the home. To enhance the product of the present invention, a switch (not illustrated) can be used to activate and/or deactivate the motor. This switch can be any conventional switch and can be at any location that may be convenient and accessible to the user.

Another feature used to enhance the final product is a timer (not illustrated). The timer can be used to prevent electricity to travel to the motor, and thus saving on the energy consumption of the present invention. It is noted that the switch and/or timer are of conventional configuration and their operation in association with the automated swing drive mechanism to provide power to the motor is of known construction to one of ordinary skill in the art.

The operator of the present invention would sit in the swing and initiate swinging in a normal manner. The adjustable cam 58 is positioned close enough to the roller arm 32 to maintain the degree of swinging motion. For example, when the adjustable cam 58 is set for a high degree of swinging motion by the previous operator and the next operator preferred a very light swinging motion, and with no adjustments made, the adjustable cam 58 would never reach the roller arm 32 to release the clutch brake 30 in order to drive the rotating arm assembly 40. Therefore, the operator who preferred a very light swing would set the adjustable cam 58 so that the adjustable cam 58 was closer to the roller arm. Of course, the setting would be reversed if the operator preferred a higher swinging motion. The present invention is constructed so that one of ordinary skill in the art would rarely be required to make any adjustments to the swinging position once the operator initially sets the most comfortable swinging position.

It is noted that the frame structure 12 of the present invention will be sized in order to be easily installed in standard household ceiling joints on minimum 16-inch centers. It is further noted that the frame structure can be located inside a freestanding frame member. This will provide for the present invention to be installed in or on conventional freestanding swings. The present invention is also designed so that the operator can swing naturally without electrical power since the present invention is comprised so that the chain 72 and the spring 74 rotate below the rotating arm assembly 40 so that no contact is made during the natural swing. In addition, due to this novel design there is no wear and tear on any of the mechanical components when operating without the motor.

While the present invention has been particularly shown and described with reference to an embodiment thereof, it will be understood by those skilled in the art that various changes in form and detail may be made without departing from the spirit and scope of the present invention.

We claim:

1. An automatic swing device comprising:

a frame member;

a motorized rotating arm assembly is secured to said frame;

a stop unit is coupled to said motorized rotation arm assembly for preventing rotation and for permitting rotation of said motorized rotating arm assembly when desired;

an initiation assembly for initiating said motorized rotating arm assembly; and a shaft is coupled to said motorized rotating arm assembly and said shaft is secured to said frame and provides rotation in a first direction and then an opposite direction for providing a swinging motion when said motorized rotating arm assembly is activated via said initiation assembly.

2. An automatic swing device as in claim 1 wherein said motorized rotating arm assembly comprises a motor coupled to a clutch brake, said clutch brake is coupled to a rotating arm assembly, said rotating arm assembly is coupled to said shaft, and said initiation assembly is coupled to said clutch brake.

3. An automatic swing device as in claim 2 wherein said motor comprises a fractional horsepower gear motor.

4. An automatic swing device as in claim 2 wherein said initiation assembly comprises a clutch arm connector coupled to said clutch brake, said clutch arm connector is coupled to said shaft and when said shaft rotates, said clutch arm connector pulls or pushes on said clutch brake for either engaging or disengaging operation of said motorized rotation arm assembly.

5. An automatic swing device as in claim 1 wherein said rotation of said shaft provides for a swing path, and said swing path is adjustable via an adjusting device.

6. An automatic swing device as in claim 1 wherein mounting brackets are secured to said frame for enabling said frame to be secured to a desired object.

7. An automatic swing device as in claim 1 wherein a damping device is coupled to said shaft, said damping device provides for a smooth and non-abrupt swinging motion of said shaft.

8. An automatic swing device as in claim 1 wherein a conventional porch swing is secured to said shaft.

9. An automatic swing device to be used in combination with a conventional porch swing, said automatic swing device comprising:

a frame member;

a motorized rotating arm assembly is secured to said frame;

a stop unit is coupled to said motorized rotation arm assembly for preventing rotation and for permitting rotation of said motorized rotating arm assembly when desired;

an initiation assembly for initiating said motorized rotating arm assembly;

a shaft is coupled to said motorized rotating arm assembly and said shaft is secured to said frame and provides rotation in a first direction and then an opposite direction for providing a swinging motion when said motorized rotating arm assembly is activated via said initiation assembly; and said shaft has a first end and a second end, each end includes an attaching mechanism;

said attaching mechanism receives a conventional porch swing.

10. An automatic swing device as in claim 9 wherein said motorized rotating arm assembly comprises a motor coupled to a clutch brake, said clutch brake is coupled to a rotating arm assembly, said rotating arm assembly is coupled to said shaft, and said initiation assembly is coupled to said clutch brake.

11. An automatic swing device as in claim 10 wherein said initiation assembly comprises a clutch arm connector coupled to said clutch brake, said clutch arm connector is coupled to said shaft and when said shaft rotates, said clutch arm connector pulls or pushes on said clutch brake for either engaging or disengaging operation of said motorized rotation arm assembly.

12. An automatic swing device as in claim 11 wherein said initiation assembly further comprises a horizontal shaft, a pair of ball joint rod ends support said horizontal shaft, located above and coupled to said ball joint rod ends is a linkage arm, said clutch arm connector is connected to said ball joint rod end, said horizontal shaft is connected to said rotating arm assembly, said clutch arm connector is coupled to said stop unit, and initiation of said rotating arm assembly causes said horizontal shaft to rotate for providing said linkage arm to tilt away from said mainframe causing said ball joint rod ends to pull said clutch arm connector.

13. An automatic swing device as in claim 11 wherein said stop unit comprises a stop point secured to clutch brake and said stop unit is in contact with said clutch arm connector, and when said clutch arm connector is pulled, said clutch arm connector disengages with said stop point.

14. An automatic swing device as in claim 13 wherein rotation of said shaft provides for a swing path, and said swing path is adjustable via an adjusting device.

15. An automatic swing device as in claim 14 wherein a cam system is used for adjusting said swing path.

16. An automatic swing device as in claim 9 wherein said rotation of said shaft provides for a swing path, and said swing path is adjustable via an adjusting device.

17. An automatic swing device as in claim 9 wherein a damping device is coupled to said shaft, said damping device provides for a smooth and non-abrupt swinging motion of said shaft.

18. An automatic swing device as in claim 9 wherein a conventional switch is coupled to said motorized rotation arm assembly for controlling power to said motorized rotation arm assembly.

19. An automatic swing device as in claim 9 wherein a conventional timer is coupled to said motorized rotation arm assembly for preventing power to travel to said motorized rotation assembly when not in use.

* * * * *